US007341811B2

(12) United States Patent
Kim et al.

(10) Patent No.: US 7,341,811 B2
(45) Date of Patent: Mar. 11, 2008

(54) ELECTROPHOTOGRAPHIC PHOTORECEPTOR USING THE ELECTRON TRANSFERRING COMPOUND

(75) Inventors: Beom-jun Kim, Seongnam-si (KR); Saburo Yokota, Suwon-si (KR); Seung-ju Kim, Suwon-si (KR); Hwan-koo Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 390 days.

(21) Appl. No.: 10/952,726

(22) Filed: Sep. 30, 2004

(65) Prior Publication Data

US 2005/0118519 A1 Jun. 2, 2005

(30) Foreign Application Priority Data

Dec. 2, 2003 (KR) ..... 10-2003-0086787

(51) Int. Cl.
*G03G 5/10* (2006.01)

(52) U.S. Cl. ..... 430/60; 430/62

(58) Field of Classification Search ..... 430/60, 430/62

See application file for complete search history.

(56) References Cited

U.S. PATENT DOCUMENTS

| | | | | |
|---|---|---|---|---|
| 5,516,610 | A | 5/1996 | Nguyen et al. | |
| 5,558,965 | A | 9/1996 | Nguyen et al. | |
| 5,631,114 | A * | 5/1997 | Nguyen et al. | 430/58.15 |
| 6,558,863 | B2 | 5/2003 | Rokutanzono et al. | |
| 6,770,785 | B1 * | 8/2004 | Desai et al. | 564/355 |
| 7,211,675 | B2 * | 5/2007 | Solanky et al. | 548/257 |

FOREIGN PATENT DOCUMENTS

| | | |
|---|---|---|
| JP | 8-220789 | 8/1996 |
| JP | 09-190003 | 7/1997 |
| JP | 2000-122314 | 4/2000 |
| KR | 1999-0036754 | 5/1999 |
| KR | 2003-0066361 | 8/2003 |

* cited by examiner

*Primary Examiner*—John L Goodrow
(74) *Attorney, Agent, or Firm*—Roylance, Abrams, Berdo & Goodman, L.L.P.

(57) ABSTRACT

New compounds having an electron transferring capability, and an electrophotographic photoreceptor including the new compounds are disclosed. The compound according to the present invention is represented by the following Formula 2:

(2)

where $R_1$, $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen; m is 0 or an integer of 1 to 4; and n is 0 or an integer of 1 to 5. These compounds can be used an electron transferring material of an undercoating layer or a photoconductive layer of an electrophotographic photoreceptor. The electron transferring material of the invention produces an electrophotographic photoreceptor having improved electrical characteristics.

12 Claims, 1 Drawing Sheet

ELECTROPHOTOGRAPHIC PHOTORECEPTOR USING THE ELECTRON TRANSFERRING COMPOUND

This application claims the benefit of Korean Patent Application No. 2003-86787 filed Dec. 2, 2003, in the Korean Intellectual Property Office, the disclosure of which is incorporated by reference in its entirety.

BACKGROUND OF THE INVENTION

1. Field of the Invention

The present invention relates to a compound which is soluble in an alcohol or alcohol type solvent and has a good electron transferring capability. More particularly, the present invention relates to an alcohol soluble electron transferring compound soluble, and to an electrophotographic photoreceptor having improved electric and magnetic properties. The invention is also directed to an electrophotographic photoreceptor having an undercoating layer or a photoconductive layer containing an alcohol soluble electron transferring compound.

2. Description of the Related Art

An electrophotographic photoreceptor is used in electrophotographic image-forming apparatuses, such as facsimile machines, copiers, laser beam printers, CRT printers, LED printers, liquid crystal printers, and laser electrophotographic devices. Basically, in an electrophotographic image-forming apparatus, a photosensitive material is electrified and exposed to an image-forming light source to form an electrostatic latent image. Then, the image is developed with toner (also referred to as ink) by applying a developing voltage. The toner image is then transferred to a recording medium such as paper, and the image is fixed thereon.

The electrophotographic photoreceptor includes a photoconductive layer containing a charge generating material (CGM) and a charge transferring material (CTM) on an electrically conductive substrate. Generally, the electrophotographic photoreceptor contains an additional functional layer. In one example, an undercoating layer is formed between the electrically conductive substrate and the photoconductive layer. In other examples, a protective layer is formed on the photoconductive layer.

The function of the undercoating layer is to improve the adhesive property between the conductive substrate and the photoconductive layer and prevent the hole injection from the conductive substrate to the photoconductive layer. Also, the undercoating layer allows easy electron transfer from the photoconductive layer.

An anodic oxidation layer of the electrically conductive substrate can be used as an undercoating layer. The undercoating layer can also be formed by preparing a coating liquid containing a polymer resin such as polyamide resin, and applying the coating liquid on the conductive substrate.

The anodic oxidation layer of the conductive layer is widely used as the undercoating layer. However, the cost is high, and thus the manufacturing cost of electrophotographic photoreceptor is increased.

When the undercoating layer contains a polymer resin, it is advantageous to have the undercoating layer as thick as possible to prevent the hole migration from the substrate to the photoconductive layer. However, as the thickness of the undercoating layer increases, the electron migration from the photoconductive layer is also reduced or prevented, and thus, the exposure potential is increased. In order to solve these problems, methods of providing an undercoating layer containing an electron transferring material have been researched.

U.S. Pat. No. 5,141,837, U.S. Pat. No. 5,589,309 and U.S. Pat. No. 5,815,776 disclose an electrophotographic photoreceptor having an undercoating layer containing a perylene compound represented by the following Formula 1 as an electron transferring material.

[Formula 1]

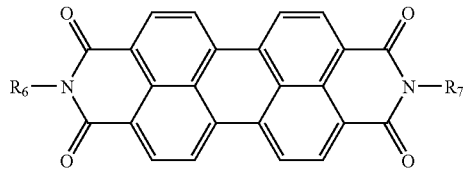

(I)

Since the perylene compound disclosed in the above-mentioned patents is insoluble in alcohol, it is used in the form of pigment dispersed in a polymer resin. However, electrons can not flow through the pigmented perylenes disclosed in the above-mentioned patents, and thus the electron transferring capacity is inferior.

In order to solve these problems, the electron transferring material contained in the undercoating layer should be soluble in the solvent used in the undercoating layer. In this regard, because solvents usually used in photoconductive layers are non-alcohol type solvents, the binder resin of the undercoating layer should be limited to materials that are soluble in alcohol type solvents in order not to be dissolved in the solvent of the photoconductive layer. In addition, alcohol type solvents in which this binder resin can be dissolved are used as the solvent of the undercoating layer. Therefore, the electron transferring material contained in the undercoating layer should be a material which can be dissolved in alcohol type solvents. However, there is no material in the prior processes that satisfy this need.

SUMMARY OF THE INVENTION

The present invention solves the above-noted problems of the prior processes and materials. Accordingly, an object of the present invention is to synthesize a new compound which is soluble in an alcohol or alcohol type solvent and has a good electron transferring capability. Another feature of the invention is to provide an electrophotographic photoreceptor having improved electrostatic properties where the new compound is used as an electron transferring material of an undercoating layer or a photoconductive layer.

The compound according to the present invention is represented by the following Formula 2:

[Formula 2]

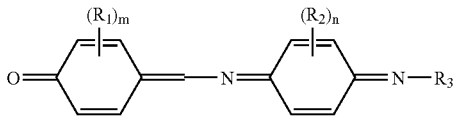

wherein $R_1$, $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen;

m is 0 or an integer of 1 to 4; and n is 0 or an integer of 1 to 5.

The compound of the above Formula 2 according to one aspect of the invention is prepared by a method comprising the steps of:

dissolving a compound represented by the Formula 3:

[Formula 3]

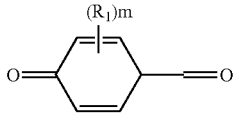

wherein $R_1$ is selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen, and m is 0 or an integer of 1 to 4, and a compound represented by the following Formula 4:

[Formula 4]

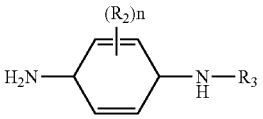

wherein $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen, and n is 0 or an integer of 1 to 5, in an alcohol or alcohol type solvent to prepare a first solution;

extracting from the first solution a solid having the following Formula 5:

[Formula 5]

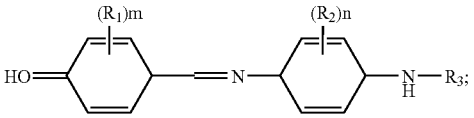

where $R_1$, $R_2$ and $R_3$ are defined above, preparing a second solution by dissolving said solid of Formula 5 in a chloroform solvent; and extracting a solid compound having the Formula 2 from the second solution.

In another aspect of the invention, the electrophotographic photoreceptor according to the present invention comprises a conductive substrate; an undercoating layer formed on said conductive substrate; and a photoconductive layer containing a charge generating material and a charge transferring material formed on said undercoating layer, wherein said undercoating layer contains an alcohol or alcohol type solvent, a binder and an electron transferring material, and the electron transferring material of said undercoating layer is a compound represented by the following Formula 6:

[Formula 6]

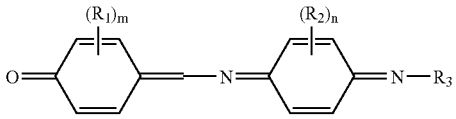

wherein $R_1$, $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen;

m is 0 or an integer of 1 to 4; and n is 0 or an integer of 1 to 5.

The binder of the undercoating layer is an alcohol-soluble compound. The thickness of said undercoating layer is preferably in the range of 1 μm to 3 μm. In preferred embodiments, the compound of the above Formula 6 is alcohol soluble.

The photoconductive layer has a single layer structure in which the charge generating material and said charge transferring material are dispersed together in a single layer. Alternatively, the photoconductive layer has a laminate structure in which a charge generating layer containing the charge generating material and a charge transferring layer containing the charge transferring material are laminated in this order onto an undercoating layer.

Another aspect of the invention is to provide a protective layer on the photoconductive layer in order to protect the photoconductive layer.

In another embodiment of the present invention, the electrophotographic photoreceptor comprises a conductive substrate; an undercoating layer formed on the conductive substrate; and a photoconductive layer containing a charge generating material and a charge transferring material formed on the undercoating layer, wherein the photoconductive layer contains a charge transferring material and a charge generating material, and where the charge transferring material of the photoconductive layer is an electron transferring material represented by the following Formula 7:

[Formula 7]

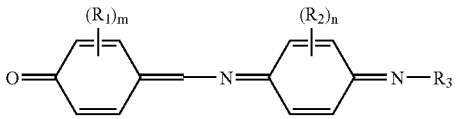

wherein $R_1$, $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen;

m is 1 or an integer of 1 to 4; and n is 0 or an integer of 1 to 5.

The photoconductive layer has a single layer structure in which the charge generating material and the electron transferring material are dispersed together in a single layer. Alternatively, the photoconductive layer has a laminate structure in which a charge generating layer containing the charge generating material and an electron transferring layer containing the electron transferring material are laminated onto each other.

In one embodiment, the photoconductive layer also contains a hole transferring material. In one preferred embodiment, a protective layer is formed on the photoconductive layer in order to protect the photoconductive layer.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1:
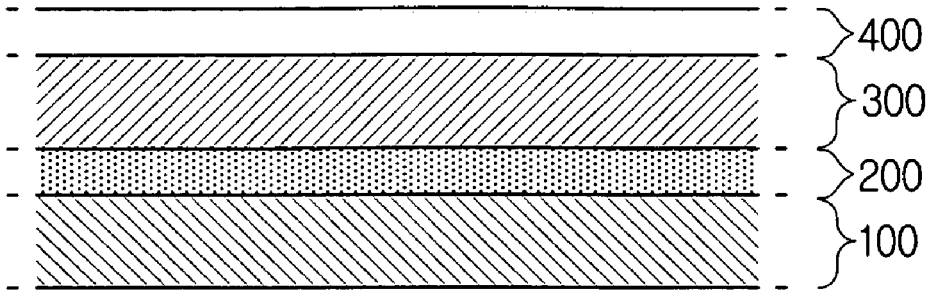
FIG. 1 is a cross-sectional view schematically showing a single layer type electrophotographic photoreceptor according to one embodiment of the present invention.

Certain embodiments of the present invention will be described in greater detail with reference to the accompanying drawings.

In the following description, the same drawing reference numerals are used for the same elements even in different drawings. The matters defined in the description such as a detailed construction and elements are provided to assist in a comprehensive understanding of the invention but are not intended to be limiting. It will be apparent to one skilled in the art that the present invention can be carried out with various modifications to the disclosed embodiments. Also, well-known functions or constructions are not described in detail.

The compound of the present invention is represented by the Formula 2,

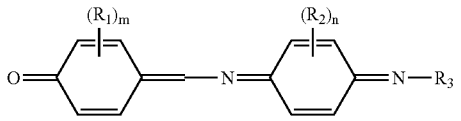

wherein $R_1$, $R_2$ and $R_3$ are independently selected from the group consisting of a substituted or unsubstituted alkyl group having about 1 to 20 carbon atom(s), a substituted or unsubstituted alkoxy group having about 1 to 20 carbon atom(s), a substituted or unsubstituted aryl group having about 6 to 30 carbon atoms, a substituted or unsubstituted aralkyl group having about 7 to 30 carbon atoms, and a halogen.

The substituted or unsubstituted alkyl group having about 1 to 20 carbon atom(s) can be linear or branched. Examples of the alkyl group include methyl, ethyl, n-propyl, isopropyl, n-butyl, isobutyl, sec-butyl, t-butyl, pentyl, hexyl, 1,2-dimethyl-propyl, and 2-ethyl-hexyl, although the alkyl group is not limited to these examples.

If the carbon number of the alkyl group is more than 20, an aggregation between molecules of the compound of the Formula 2 can occur. Thus, when a compound of Formula 2 having more than 20 carbon atoms in the $R_1$, $R_2$ or $R_3$ groups is used in an undercoating layer or photoconductive layer of the photoreceptor, the dispersibility of the compound is reduced, so that the electron transferring capacity is reduced. Therefore, it is preferable that the carbon number of the alkyl group is about 1 to 20. In addition, the substituent of a substituted alkyl group is not particularly limited.

The substituted or unsubstituted alkoxy group having about 1 to 20 carbon atom(s) can be linear or branched. Examples of the alkoxy group include methoxy, ethoxy, propoxy, butoxy, and pentyloxy, although the alkoxy group is not limited to these examples.

If the carbon number of the alkoxy group is more than 20, an aggregation between molecules of the compound of the Formula 2 can occur. Thus, when a compound of Formula 2 having no more than 20 carbon atoms in the $R_1$, $R_2$ or $R_3$ groups is used in an undercoating layer or photoconductive layer of the photoreceptor, the dispersibility of the compound is reduced, so that the electron transferring capacity is reduced. Therefore, it is preferable that the carbon number of the alkoxy group is about 1 to 20. In addition, the substituent of a substituted alkoxy group is not particularly limited.

For the substituted or unsubstituted aryl group having about 6 to 30 carbon atoms, it is preferable that the carbon number of the aryl group is about 6 to 30 to provide the desired dispersibility and electron transferring capability of the compound of the Formula 2 for the reasons discussed above in connection with the alkyl group and the alkoxy group. Examples of the aryl group include phenyl, tolyl, silyl, biphenyl, o-terphenyl, naphthyl, anthryl, and phenanthryl, although the aryl group is not limited to these examples.

For the substituted or unsubstituted aralkyl group having about 7 to 30 carbon atoms, it is preferable that the carbon number of the aralkyl group is about 7 to 30 since the dispersibility and electron transferring capability of the compound of the Formula 2 are reduced when the carbon number of the aralkyl group is more than 30 for the reasons discussed in connection with the alkyl group, the alkoxy group and the aryl group. The term aralkyl group as used herein refers to a $Ar(CH_2)_n$— group in which a carbon atom of an alkyl group is substituted with an aromatic hydrocarbon group (aryl group) such as phenyl, and anthryl, and is used as a shortened form of the term "arylalkyl" group. Examples of the aralkyl group include benzyl ($C_6H_5CH_2$—), and phenethyl ($C_6H_5CH_2CH_2$—), although the aralkyl group is not limited to these examples.

The compound of the present invention represented by the above Formula 2 is exemplified by the following compounds, but it is not limited thereto.

[Formula 8]

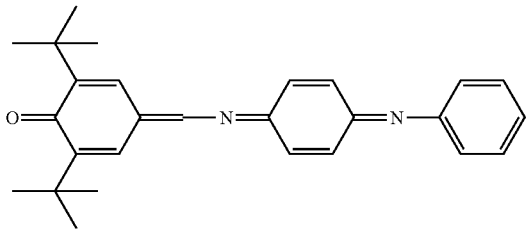

-continued
[Formula 9]
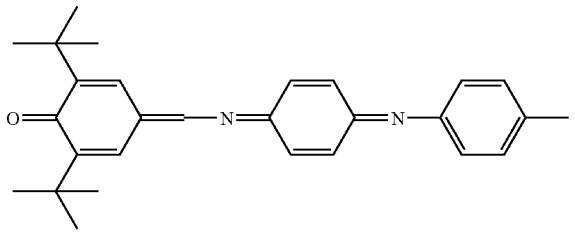
[Formula 10]
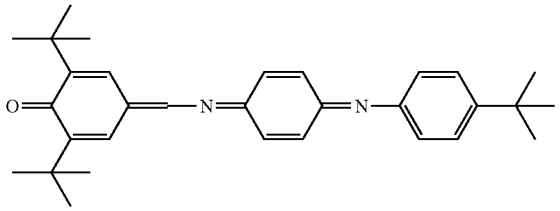
[Formula 11]
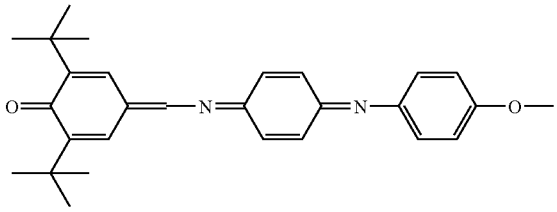
[Formula 12]
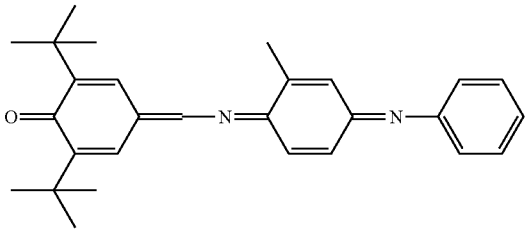
[Formula 13]
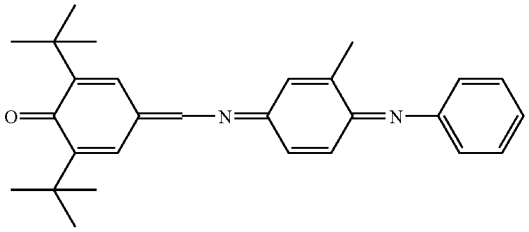
[Formula 14]
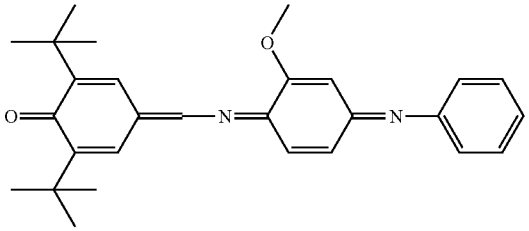
-continued
[Formula 15]
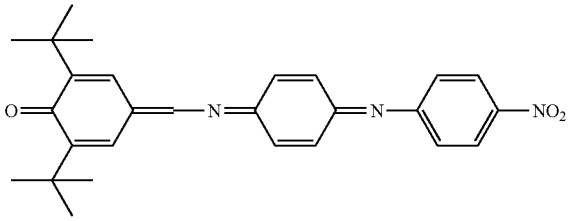
[Formula 16]
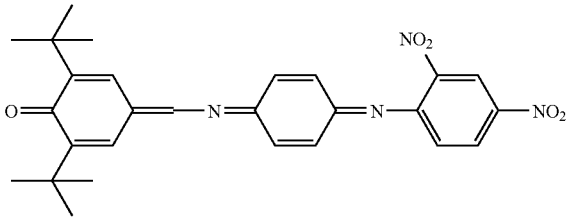
[Formula 17]
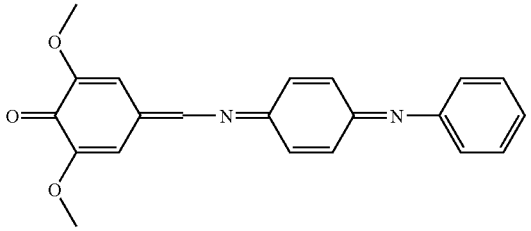
[Formula 18]
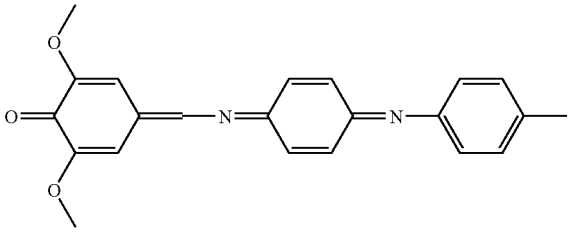
[Formula 19]
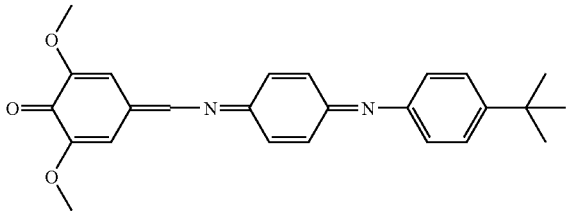
[Formula 20]
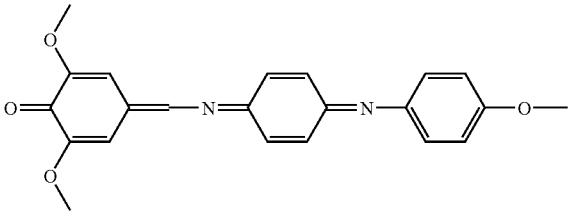

-continued

[Formula 21]

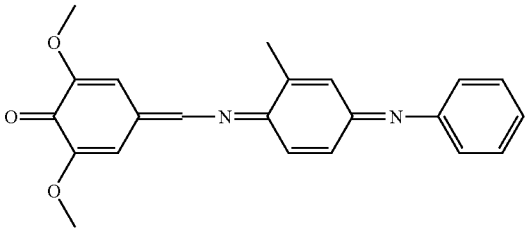

[Formula 22]

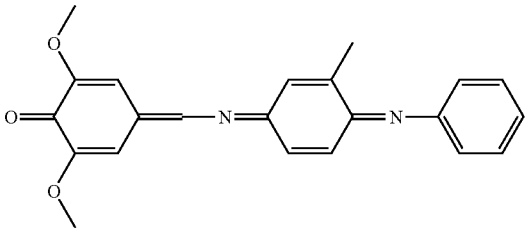

[Formula 23]

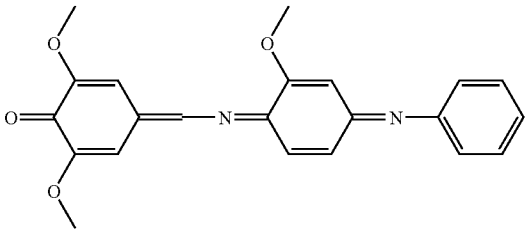

[Formula 24]

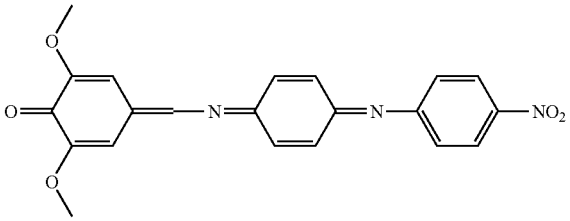

[Formula 25]

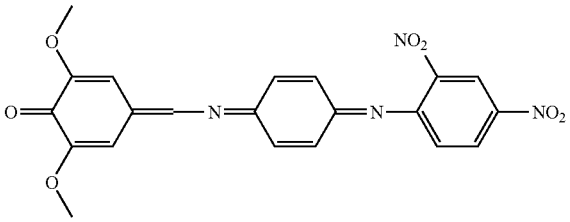

The method for preparing the compound of the Formula 2 is described herein. In the following discussion, the compound of Formula 2 is obtained by reacting compounds of Formula 3 and Formula 4. The compounds of Formula 3 have the structure

[Formula 3]

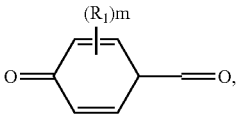

wherein $R_1$ is selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen, and m is 0 or an integer of 1 to 4. Formula 4 is as follows:

[Formula 4]

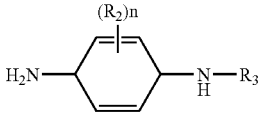

wherein $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen, and n is 0 or an integer of 1 to 5.

The compound represented by Formula 3 and the compound represented by Formula 4 are dissolved in an alcohol or alcohol type solvent to prepare a solution. Then, after an aqueous solution of a strong acid is added dropwise to the solution, the resultant solution is refluxed and cooled to room temperature, and the precipitated compound (a) is collected. This reaction is shown in the following reaction Equation 1.

[Equation 1]

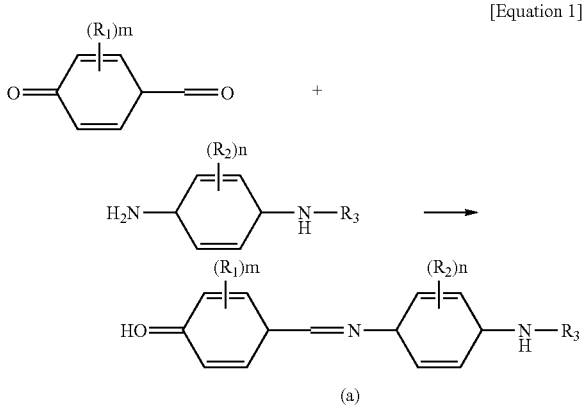

After the solid (a) obtained by the above reaction Equation 1 is extracted, it is dissolved in chloroform solvent, and an oxidant is added dropwise thereto. Then, the resulting solution is stirred, and the compound of Formula 2 is produced and recovered from this solution. This reaction is shown in the following reaction Equation 2.

[Equation 2]

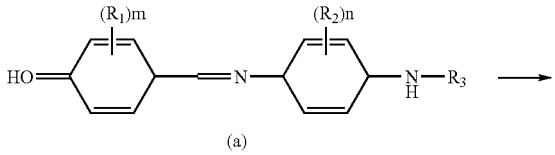

-continued

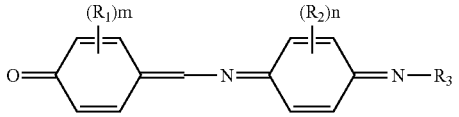

As shown in Equations 1 and 2, each of substituents $R_1$, $R_2$ and $R_3$ of the compound of the above Formula 2 originates from each reactant, and each substituent remains as it is in the compound of the Formula 2 produced according to the reaction scheme.

Although various oxidants can be used in the above method for producing the final compound, it is preferable to use metallic oxides.

The compound of Formula 2 of the present invention can be used as an electron transferring material in an undercoating layer or photoconductive layer of an electrophotographic photoreceptor.

The electrophotographic photoreceptor in which the compound of Formula 2 is used as an electron transferring material of undercoating layer is described in the following.

When a compound of Formula 2 is used as an electron transferring material contained in an undercoating layer of an electrophotographic photoreceptor, the electrophotographic photoreceptor comprises an electrically conductive substrate, an undercoating layer formed on the conductive substrate layer, and a photoconductive layer containing a charge generating material and a charge transferring material formed on the undercoating layer.

The conductive substrate of the electrophotographic photoreceptor must be a material which is electrically conductive. Suitable examples of materials that can be used for the electrically conductive substrate include metals such as aluminum, copper, tin, platinum, gold, silver, vanadium, molybdenum, chrome, cadmium, titanium, nickel, indium, stainless steel or brass; plastic materials on which a metal is deposited or laminated; or glasses coated with aluminum iodide, tin oxide, and indium oxide. The materials can be used in the form of drum or belt as commonly used in the industry.

The photoconductive layer can be a laminate type where a charge generating layer and a charge transferring layer are laminated. The photoconductive layer can alternatively be a single layer type where a charge generating material and a charge transferring material are dispersed in a single layer.

The charge generating material which can be used in the photoconductive layer includes, for example, organic compounds such as phthalocyanine dye, azo dye, quinone dye, pherylene dye, indigo dye, bisbenzoimidazole dye, quinaclydone dye, pyrilium pigments, triarylmethane pigments, and cyanine pigments; or inorganic compounds such as amorphous silicon, amorphous selenium, tellurium, selenium-tellurium alloy, cadmium sulfide, antimony sulfide, and zinc sulfide. However, it is not limited thereto.

The compounds for the charge generating material of the photoconductive layer can be used individually or in combination.

The charge transferring material contained in the photoconductive layer can be divided into two classes: a hole transferring material and an electron transferring material. The charge transferring material can comprise the hole transferring material in addition to the electron transferring material.

Examples of the electron transferring material include benzoquinone, cyanethylene, cyano quinodimethane, fluorenone, phenanthraquinone, anhydrous phthalic acid, thiopyrane, naphthalene, diphenoquinone, and stilbenequinone. Examples of the hole transferring material include poly-N-vinylcarbazole, phenanthrene, N-ethylcarbazole, 2,5-diphenyl-1,3,4-oxadiazole, 2,5-bis-(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline, tetra(m-methylphenyl)methaphenylenediamine, N,N,N',N'-tetraphenylbenzidine derivative, and N,N'-diphenyl-N,N'-disilylbenzidine.

The charge transferring material used in the electrophotographic photoreceptor of the present invention is not limited to the above-mentioned compounds. The compounds used for the charge transferring material can be used individually or in combination with each other.

The above-mentioned charge generating material and charge transferring material are dispersed in a binder resin. Examples of the binder resin include styrene-butadiene copolymer; polyvinyl toluene-styrene copolymer; silicone resin, styrene-alkyd resin, silicone-alkyd resin; soya-alkyd resin; poly(vinyl chloride); poly(vinylidene chloride); vinylidene chloride-acrylonitrile copolymer; poly(vinyl acetate); vinyl acetate-vinyl chloride copolymer; and poly (vinyl acetal) such as poly(vinyl butyral); poly(acrylic and methacrylic ester) such as poly(methyl methacrylate), poly (n-butyl methacrylate), and poly(isobutyl methacrylate); polystyrene, nitrated polystyrene; polymethylstyrene; isobutylene polymer; polyester such as poly[4,4'-(2-norbornylidene)bisphenylene azelate-co-terephtalate (60/40)], and poly[ethylene-co-alkylene-bis(alkylene-oxyaryl)-phenylenedicarboxylate]; phenolformaldehyde resin; ketone resin; polyamide; polycarbonate; polythiocarbonate; poly [ethylene-co-isopropylidene-2,2'-bis(ethyleneoxyphenylene)terephtalate]; copolymer of vinyl haloarylate and vinyl acetate, such as poly(vinyl-m-bromobenzoate-co-vinyl acetate); chlorinated polyolefin such as chlorinated polyethylene; and compounds equivalent to these compounds. It is especially preferable to use polyester or polycarbonate.

Examples of the solvent used in the photoconductive layer of the electrophotographic photoreceptor include organic solvents such as ketone type solvents, amide type solvents, ether type solvents, ester type solvents, sulphone type solvents, aromatic type solvents, and aliphatic halogenated hydrogen chloride type solvents. The solvent is not limited to the specifically disclosed solvents and it is to be understood that other solvents can also be used.

When methyl ethyl ketone (MEK) or tetrahydrofuran (THF) is used as the solvent of the photoconductive layer of the electrophotographic photoreceptor, it is preferable that the binder resin of the undercoating layer be insoluble in the solvent of the photoconductive layer. This binder resin is exemplified by alcohol-soluble resins and thermosetting resins.

Among alcohol-soluble resins, polyamide type resins are usually used as a binder resin. Therefore, a polyamide type resin is used as the binder resin of the undercoating layer and an alcohol type solvent is used as the solvent of the undercoating layer.

There are many kinds of alcohol-soluble polyamide resins such as nylon 6, 8, 11, 12, 66, 610, 612 depending on the monomer used to produce the nylon. Copolymers of the polyamides and their variants are also commercially available. Any of the above-mentioned polyamide type resins can be used in the present invention. Examples of commercially available polyamide type resin include AMILAN (Toray), DIAMID and VESTAMID (Daicel-Degussa), ULTRAMID (BASF), and TORESIN (Nagase Chemtex). It is understood that numerous other commercially available polyamide resins can be used.

The alcohol or alcohol type solvent which can be use in the undercoating layer is not particularly limited. Examples of suitable alcohols include lower alkyl alcohols such as methanol, ethanol, propanol and butanol, and mixtures thereof. In one embodiment, the solvent is a mixture of methanol and butanol. The ratio of the mixture can be, for example, 8:2 of methanol/butanol.

The electron transferring material of the undercoating layer is the compound represented by Formula 2, and exemplified by the specific compounds represented by Formula 8 to Formula 25. The compounds within the scope of Formula 2 are not limited to the specific compounds identified by Formula 8 to Formula 25.

The undercoating layer is formed by mixing and dispersing the polyamide type resin and electron transferring material in the alcoholic solvent to prepare a coating liquid for forming the undercoating layer by applying the coating liquid on the conductive substrate.

The thickness of the undercoating layer is preferably in the range of 1 μm to 3 μm. If thickness of the undercoating layer is less than 1 μm, it is difficult to prevent the hole migration from the conductive substrate to the photoconductive layer. If the thickness of the undercoating layer is more than 3 μm, the electron migration from the photoconductive layer is prevented, so the exposure potential of the electrophotographic photoreceptor is increased.

The electrophotographic photoreceptor of the present invention can contain additionally a protective layer for protecting the photoconductive layer.

The compound represented by the Formula 2 is used as the electron transferring material of the undercoating layer, as described above, because the compound has a characteristic of absorbing the light of a specific wavelength, and particularly at a wavelength of 780 nm. When the compound is used as an electron transferring material of a photoconductive layer of an electrophotographic photoreceptor for laser light of the specific wavelength as a light source, the compound absorbs the light which makes the charge generation in charge generating materials by light absorption difficult. Therefore, in this case, said compound can not be used as the electron transferring material of the electrophotographic photoreceptor. However, in the case of an electrophotographic photoreceptor where the light source is laser light of a wavelength other than the specific wavelength, the compound can be used as the electron transferring material of the electrophotographic photoreceptor.

Therefore, a compound of Formula 2 can be used in the electrophotographic photoreceptor comprising an electrically conductive substrate, an undercoating layer formed on the conductive layer, and a photoconductive layer containing a charge generating material and a charge transferring material formed on the undercoating layer, wherein said photoconductive layer contains a charge transferring material and a charge generating material. The compound of Formula 2 is contained as the electron transferring material which forms the charge transferring material of the photoconductive layer. The conductive substrate and the photoconductive layer are as described above.

Figure 2:
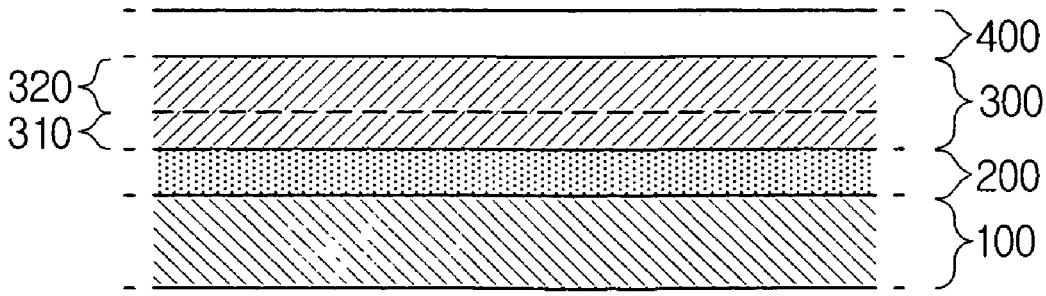
FIG. 2 is a cross-sectional view schematically showing a laminate type electrophotographic photoreceptor according to another embodiment of the present invention.

FIGS. 1 and 2 schematically show examples of above-described electrophotographic photoreceptors according to the present invention. In the drawings, the same drawing reference numerals are used for the same elements in the different Figures.

Referring to FIGS. 1 and 2, a conductive layer (100), an undercoating layer (200) formed on the conductive layer (100), a photoconductive layer (300) formed on the undercoating layer (200), and a protective layer (400) formed on the photoconductive layer (300) are laminated in the order described and shown.

The example shown in FIG. 1 represents a single layer type electrophotographic photoreceptor where the photoconductive layer (300) has a single layer structure wherein the charge generating material and the charge transferring material are dispersed together within the layer 300.

The example shown in FIG. 2 represents a laminate type electrophotographic photoreceptor in which the photoconductive layer (300) has a laminate structure wherein the charge generating layer (310) has the charge generating material dispersed therein and the charge transferring layer (320) has the charge transferring material dispersed therein laminated to each other.

The present invention will now be explained more specifically with reference to the following Examples. It will be understood that the present invention is not restricted by these Examples.

EXAMPLES

[Synthesis of Electron Transferring Material]

Example 1

In Example 1, the compound of Formula 8 as defined above, was synthesized by a process of reaction equations 1 and 2.

23.4 g (0.1 mol) of 3,5-di-tert-butyl-4-hydroxy-benzaldehyde represented by the following Formula 26:

[Formula 26]

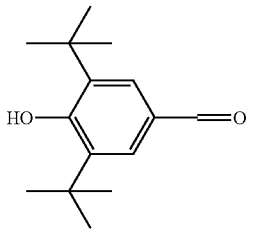

and 18.4 g (0.1 mol) of N-phenyl-P-phenylenediamine represented by the following Formula 27:

[Formula 27]

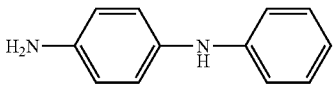

were added dropwise to 300 ml of ethanol, and the temperature was increased to dissolve these compounds and form a first solution.

One drop of aqueous solution of high concentration hydrochloric acid (HCl) was then added to the first solution, and refluxed for 2 hours. The refluxed solution was cooled to room temperature, and the precipitated solid was filtered and recovered. The recovered solid was recrystallized with acetone/ethanol cosolvent to obtain 32.8 g of an orange solid. The orange solid was represented by the following Formula 28:

[Formula 28]

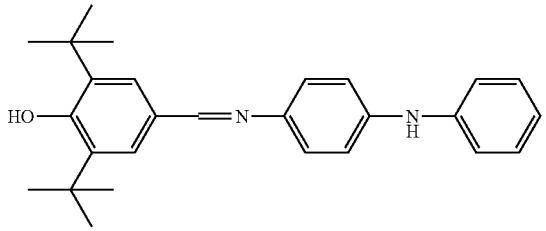

The yield of the compound of the Formula 28 was 82%.

20 g (0.05 mol) of the orange solid was added dropwise to 150 ml of chloroform and dissolved therein to form a second solution. 30 g of manganese oxide was then added slowly to the second solution, and the resultant solution was stirred for 2 hours at room temperature. After the reaction was completed, the resultant solution was filtered to remove the manganese oxide, and the solvent was evaporated to obtain a solid. The obtained solid was recrystallized with ethanol/water cosolvent. In this way, 15.65 g of a brown solid was obtained having the Formula 8. The yield of the brown solid of Formula 8 was 78%.

[Preparation of Electrophotographic Photoreceptor]

Example 2

Formation of Undercoating Layer

AMILAN CM-8000 manufactured by Toray and the brown solid of Formula 8 prepared in Example 1 were dissolved in the ratio of 1:1 in methanol/butanol (8:2) cosolvent to prepare a solution of 10% concentration. This solution was diluted to a solution of 5% concentration to prepare a coating liquid for forming an undercoating layer.

The coating liquid was coated by a ring coating process on an aluminum drum at the rate of 150 mm/min., and dried for 60 minutes at 70° C., to obtain an undercoating layer having a thickness of about 1 μm.

Formation of Charge Generating Layer

Gamma type titanyl phthalocyanine (γ-TiPOc, manufactured by H.W. Sands) as a charge generating material and polyvinylbutyral (PVB, BX-1 manufactured by Sekisui Chemical Co., Ltd.) as a binder were milled in the ratio of 7/3 in methyl ethyl ketone (MEK) solvent to prepare a solution of 15% by weight concentration. This solution was diluted to a solution of 5% concentration to prepare a coating liquid for forming a charge generating layer.

The coating liquid was coated by a ring coating process on the undercoating layer formed as described above at the rate of 200 mm/min., and dried for 60 minutes at 70° C., to obtain a charge generating layer having a thickness of about 0.5 μm.

Formation of Charge Transferring Layer (Formation of Hole Transferring Material)

MPCT 10 (manufactured by Mitsubishi Paper Mills) as a hole transferring material and PCZ 200 as a polycarbonate type binder resin were dissolved in the ratio of 1:1 in tetrahydrofuran (THF) solvent of 20% concentration to prepare a coating liquid for forming a charge transferring layer.

The coating liquid was coated by a ring coating process on the charge generating layer formed as described above at the rate of 300 mm/min., and dried for 60 minutes at 80° C., to obtain a charge transferring layer of about 10 μm thickness to produce an electrophotographic photoreceptor.

Comparative Example 1

Formation of Undercoating Layer

AMILAN CM-8000 manufactured by Toray was dissolved in methanol/butanol (8:2) cosolvent to prepare a coating liquid for forming an undercoating layer as a solution of 5% concentration.

The coating liquid was coated by a ring coating process on an aluminum drum at the rate of 150 mm/min., and dried for 60 minutes at 70° C., to obtain an undercoating layer having a thickness of about 1 μm.

Formation of Charge Generating Layer

A charge generating layer was formed in the same manner as in Example 2 except that the undercoating layer had a different composition from the composition used in Example 2.

Formation of Charge Transferring Layer (Formation of Hole Transferring Material)

A charge transferring layer was formed in the same manner as in Example 2 except that the undercoating layer had a different composition from the composition used in Example 2.

Comparative Example 2

Formation of Undercoating Layer

A perylene type pigment (L3920 manufactured by Paliogen Maroon) and AMILAN CM-8000 manufactured by Toray were dissolved in the ratio of 1:1 in methanol/butanol (8:2) cosolvent to prepare a solution of 5% concentration as a coating liquid for forming an undercoating layer.

The coating liquid was coated by a ring coating process on an aluminum drum at the rate of 150 mm/min., and dried for 60 minutes at 70° C., to obtain an undercoating layer having a thickness of about 1 μm.

Formation of Charge Generating Layer

A charge generating layer was formed in the same manner as in Example 2 except that the undercoating layer had a different composition from the composition of Example 2.

Formation of Charge Transferring Layer (Formation of Hole Transferring Material)

A charge transferring layer was formed in the same manner as in Example 2 except that the undercoating layer having a different composition formed as described above was used.

Comparative Example 3

Formation of Charge Generating Layer

A charge transferring layer was formed in the same manner as in Example 2 except that the undercoating layer is omitted.

Formation of Charge Transferring Layer (Formation of Hole Transferring Material)

A charge transferring layer was formed in the same manner as in Example 2 except that the undercoating layer is omitted.

TEST

In order to evaluate the electrical characteristics of the electrophotographic photoreceptors prepared in Example 2 and Comparative Examples 1 to 3, the initial charging potential and exposure potential and the charging potential and exposure potential after 500 cycles were measured and compared. The results are shown in Table 1.

TABLE 1

| | $V_0$ | $V_r$ | $V_0$ 500 | $V_r$ 500 |
|---|---|---|---|---|
| Example 2 | −767 | −70 | −773 | −130 |
| Comparative Example 1 | −629 | −61 | −652 | −140 |
| Comparative Example 2 | −427 | −18 | −697 | −32 |
| Comparative Example 3 | −556 | −17 | −559 | −26 |

In Table 1, $V_0$ is an initial charging potential, $V_r$ is an initial exposure potential, $V_0$ 500 is a charging potential after 500 cycles, and $V_r$ 500 is an exposure potential after 500 cycles.

Since all electrophotographic photoreceptors prepared in Example 2 and Comparative Examples 1 to 3 are (−) type electrophotographic photoreceptors, all potential values are negative.

In electrophotographic photoreceptors prepared in Example 2 and Comparative Examples 1 and 2, each of undercoating layers, charge generating layers and charge transferring layers has same thickness respectively, and each of charge generating layers and charge transferring layers also has same composition.

With the exception of the electrophotographic photoreceptor of Comparative Example 3 where an undercoating layer is not formed, the increase of the absolute value of the charging potential value after 500 cycles is the least for the electrophotographic photoreceptor produced according to Example 2. The surface charging potential of an electrophotographic photoreceptor needs to be maintained uniformly, and most ideally, the surface charging potential of an electrophotographic photoreceptor is uniform after several uses. By maintaining a uniform charging potential, the developing and transferring of a desired image are achieved smoothly, and result in a high definition printed image. Therefore, the electrophotographic photoreceptor according to Example 2 can maintain a uniform definition of an image after prolonged use.

When the electrophotographic photoreceptor of Example 2 where the compound of Formula 2 of the present invention is used as the electron transferring material of the undercoating layer is compared with the electrophotographic photoreceptor of Comparative Example 1 having no electron transferring material in the undercoating layer, the increase of the absolute value of the exposure potential of the electrophotographic photoreceptor of Example 2 is smaller. This is because the electron transferring material of the undercoating layer of Example 2 transfers electrons quickly, and thus, contributes to inhibit the increase of the absolute potential value of exposed surface.

In the case of the electrophotographic photoreceptor of Comparative Example 2 in which the perylene type pigment is used, though the increase of the absolute value of the exposure potential is relatively small, the increase of the absolute value of the charging potential is very large. Therefore this electrophotographic photoreceptor can not be used for a prolonged period.

In the case of the electrophotographic photoreceptor of Comparative Example 3 that does not have an undercoating layer, though the increase of the absolute value of the exposure potential and the increase of the absolute value of the charging potential are the least, the initial charging potential value is very small as compared with the electrophotographic photoreceptor of Example 2. This is because holes are injected from the substrate to the photoconductive layer, and thus, the electrophotographic photoreceptor of Example 2 where an undercoating layer is used has a large effect in preventing the injection of the hole from the substrate to the photoconductive layer.

According to the present invention, the new electron transferring material is synthesized where the material has a good electron transferring capability and is soluble in an alcohol type solvent, and can be used as an electron transferring material of an undercoating layer. An electrophotographic photoreceptor including the electron transferring material has excellent electrical properties and provides excellent image quality even after being used for a prolonged period. In addition, the new electron transferring material of the present invention can be used in a photoconductive layer of an electrophotographic photoreceptor where a light source of a specific wavelength is used.

While preferred embodiments of the invention have been described and illustrated, it should be understood that the present invention is not limited thereto or thereby. Many alternatives, modifications and variations will be apparent to those having skill in the art without departing from the scope and spirit of the present invention as defined in the following claims.

What is claimed is:

1. An electrophotographic photoreceptor comprising;

a conductive substrate;

an undercoating layer formed on said conductive substrate; and a photoconductive layer containing a charge generating material and a charge transferring material formed on said undercoating layer, wherein said undercoating layer contains an alcohol solvent, an alcohol-soluble binder and an alcohol-soluble electron transferring material, and where the electron transferring material of the undercoating layer is a compound represented by the Formula 2:

Formula 2

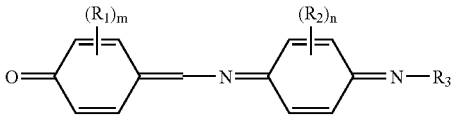

where $R_1$, $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen;

m is 0 or an integer of 1 to 4; and n is 0 or an integer of 1 to 5.

2. The electrophotographic photoreceptor according to claim 1, wherein said undercoating layer has a thickness in the range of 1 μm to 3 μm.

3. The electrophotographic photoreceptor according to claim 1, wherein said photoconductive layer has a single layer structure in which said charge generating material and said charge transferring material are dispersed together in a single layer.

4. The electrophotographic photoreceptor according to claim 1, wherein said photoconductive layer has a laminate structure in which a charge generating layer containing said charge generating material and a charge transferring layer containing said charge transferring material are laminated together.

5. The electrophotographic photoreceptor according to claim 4, wherein said charge generating layer is laminated to said undercoating layer and said charge transferring layer is laminated to said charge generating layer.

6. The electrophotographic photoreceptor according to claim 1, wherein a protective layer is formed on said photoconductive layer to protect said photoconductive layer.

7. An electrophotographic photoreceptor comprising;

a conductive substrate;

an undercoating layer formed on said conductive substrate; and a photoconductive layer containing a charge generating material and a charge transferring material formed on said undercoating layer, wherein said photoconductive layer contains a charge transferring material and a charge generating material, and where the charge transferring material of the photoconductive layer is an electron transferring material represented by the Formula 2:

(2)

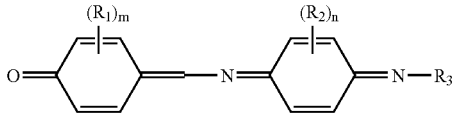

wherein $R_1$, $R_2$ and $R_3$ are independently selected from the group consisting of a substituted or unsubstituted $C_1$ to $C_{20}$ alkyl group, a substituted or unsubstituted $C_1$ to $C_{20}$ alkoxy group, a substituted or unsubstituted $C_6$ to $C_{30}$ aryl group, a substituted or unsubstituted $C_7$ to $C_{30}$ aralkyl group, and a halogen;

m is 0 or an integer of 1 to 4; and n is 0 or an integer of 1 to 5.

8. The electrophotographic photoreceptor according to claim 7, wherein said photoconductive layer has a single layer structure in which said charge generating material and said electron transferring material are dispersed together in a single layer.

9. The electrophotographic photoreceptor according to claim 7, wherein said photoconductive layer has a laminate structure in which a charge generating layer containing said charge generating material and an electron transferring layer containing said electron transferring material are laminated together.

10. The electrophotographic photoreceptor according to claim 9, wherein said charge generating layer is laminated to said undercoating layer and said charge transferring layer is laminated to said charge generating layer.

11. The electrophotographic photoreceptor according to claim 7, wherein said photoconductive layer further contains a hole transferring material.

12. The electrophotographic photoreceptor according to claim 7, wherein a protective layer is further formed on said photoconductive layer to protect said photoconductive layer.

* * * * *